US009861874B2

(12) United States Patent
Kim

(10) Patent No.: US 9,861,874 B2
(45) Date of Patent: Jan. 9, 2018

(54) TENNIS SWING TRAINING APPARATUS FOR PROPER MOVEMENT IN TENNIS SWINGS AND METHOD OF USING THE SAME APPARATUS

(71) Applicant: Sky Kim, Los Angeles, CA (US)

(72) Inventor: Sky Kim, Los Angeles, CA (US)

( * ) Notice: Subject to any disclaimer, the term of this patent is extended or adjusted under 35 U.S.C. 154(b) by 149 days.

(21) Appl. No.: 14/944,161

(22) Filed: Nov. 17, 2015

(65) Prior Publication Data

US 2017/0021263 A1 Jan. 26, 2017

Related U.S. Application Data

(60) Provisional application No. 62/196,923, filed on Jul. 25, 2015.

(51) Int. Cl.

| | |
|---|---|
| ***A63B 69/38*** | (2006.01) |
| ***A63B 69/00*** | (2006.01) |
| *A63B 71/06* | (2006.01) |

(52) U.S. Cl.

CPC ..... *A63B 69/38* (2013.01); *A63B 69/0059* (2013.01); *A63B 69/385* (2013.01); *A63B 2071/0655* (2013.01); *A63B 2209/10* (2013.01)

(58) Field of Classification Search

CPC ... A63B 69/38; A63B 69/385; A63B 69/0057; A63B 69/0059; A63B 69/3608; A63B 2071/0655; A63B 2209/10

See application file for complete search history.

(56) References Cited

U.S. PATENT DOCUMENTS

| | | | | |
|---|---|---|---|---|
| 7,758,437 | B1 * | 7/2010 | Stewart | A63B 69/3608 473/212 |
| 9,072,957 | B1 * | 7/2015 | Chuck | A63B 69/0059 |
| 2008/0015042 | A1 * | 1/2008 | Glass | A63B 69/3608 473/217 |
| 2008/0119299 | A1 * | 5/2008 | Merrill | A63B 69/0057 473/212 |
| 2010/0048332 | A1 * | 2/2010 | Torres | A63B 69/0002 473/458 |
| 2013/0304113 | A1 * | 11/2013 | Eikman | A61B 17/1322 606/203 |
| 2015/0157914 | A1 * | 6/2015 | Magstadt | A63B 69/0071 473/450 |
| 2015/0224382 | A1 * | 8/2015 | Hall | A63B 69/0059 473/450 |
| 2017/0021263 | A1 * | 1/2017 | Kim | A63B 69/38 |

* cited by examiner

*Primary Examiner* — Raleigh W Chiu
(74) *Attorney, Agent, or Firm* — Joh K. Park; Park Law Firm

(57) ABSTRACT

A tennis swing training apparatus is provided, which is a spherical spacer with a strap with a fastening device to hold the strap on the arms, to prevent the spherical spacer from switching position or falling out during the process of the swing, which when put in between a limb from a body part or strategically placed on the body it separates or holds the arm and swing into position to maintain proper position by having the player squeeze or feel the feedback of the apparatus. The apparatus can be used to help fix most of swings and shots used in tennis including one handed forehand, two-handed backhand, forehand and backhand volley, forehand slice, one-handed backhand slice, overhead, and the serve.

8 Claims, 14 Drawing Sheets

TENNIS SWING TRAINING APPARATUS FOR PROPER MOVEMENT IN TENNIS SWINGS AND METHOD OF USING THE SAME APPARATUS

CROSS-REFERENCE

This application claims priority to U.S. Provisional Patent Application No. 62/196,923 filed Jul. 25, 2015.

BACKGROUND OF THE INVENTION

Field of the Invention

The present invention and method relates generally to an article configured to be placed on a tennis players arms to maintain the tennis players arms in the proper position throughout a tennis swing.

Background

Tennis is a very popular game in the United States, even more so globally. More than 17 million people play tennis in the United States. Having a good tennis swing is one of the main key components to master the game of tennis. Unfortunately, most players are not born with the skill to have a good swing but it can be developed. The problem in the field of tennis is that having a proper swing or technical importance is ignored way too often. The coaches ask the players to rely on their mental toughness to get the ball in the court, which is very stressful and time consuming to improve in tennis. Not only that, the quality of tennis is very low when the game is played just to get the ball over and into the court without any strategy. The method and the apparatus can help the player by helping them improve their tennis swings.

Currently there are a number of solutions and methods for teaching and fixing a particular shot and swing in tennis. One of these solutions attempts to fix a swing with an object to place on the body, but these solutions fail to meet the needs of the industry because any object on a body, drops, moves, and rolls on the tennis court when reproducing a swing. The time to put the object back into position to practice a repeated stroke takes too much time and also can be dangerous in tennis because the player is not always stationary when hitting a moving tennis ball, which can cause ankle sprains and other injuries when the player steps on the object/ball. Therefore, there currently exists a need in the industry for a device and associated method that holds the ball in position it is originally placed. Different solutions attempt to fix a swing by putting a complicated device on the player, but these solutions are similarly unable to meet the needs of the industry because they are bulky, complex, expensive, and takes multiple people to utilize because of difficulty of putting the device on the body. Still other solutions seek to aid fixing a particular stroke or swing in tennis by putting on a device, but these solutions also fail to meet industry needs because the user does not get enough feedback and it restricts too much movement to replicate the "feel" of using a particular group of muscles and parts of the body to generate a proper swing. Lastly, there are no other methods and apparatus that are created to aid in fixing common mistakes of all the shot in the game of tennis.

In the game of tennis, nearly all levels from beginners to pros have common swing problems and the method to teach the players the correct swings are not obvious in any way for someone to figure out in a short amount of time and takes too long to find the correct positioning to feel comfortable for the players. With this coaching method and apparatus, it solves a lot of the improper swing techniques in tennis. The apparatus and method can be used to aid in fixing the following but not limited to: one-handed forehand, two-handed forehands, two-handed backhand, one-handed backhand, forehand volley, backhand volley, one handed forehand slice, one-handed backhand slice, overhead/smash, and the serve.

Also most of the players cannot afford to have a coach next to them all the time to fix their swing to a proper swing. Even when taking lessons and coaching to fix the swing, the players swing goes back to the original improper technique because they don't have any feedback of what they are doing in practice by themselves. Even if the player misses the ball as long as the player could feel what they did wrong they can fix it by adjusting or changing a part of their swing on their own. This is where a talented player knows the feel what they are doing on their swing. Unfortunately, not all players have that kind of talent. With the apparatus and the method associated with the apparatus, the player is able to feel if the ball was touching their body or not throughout the swing thus giving constant and instant feedback while reproducing tennis swing. Which also creates less frustration to be able to self-correct a swing instead of not knowing what to do with their swing.

Another problem is that in the field of tennis, the method used to teach or coach players' swing is a very abstract process. Most of coaches know when they see a good proper swing but do not understand why and how to teach the players with improper swing to be able to reproduce a proper swing. This method and apparatus helps the coaches fix common symptoms of multiple swings in tennis without having to understand the full extent of the scientific knowledge of tennis or tennis specific terms nor having the experience of hitting the tennis ball with a proper swing. Not only that, it will help large tennis academies teach tennis swings and fix swings consistently to many players with the method and apparatus instead of a single coach coaching a small group of players. Therefore, there currently exists a need in the industry for a device and associated method that aids in fixing and teaching tennis swings.

Surprisingly, similar problems exists at the top level pro tennis players on tour. The problem is that changing their swing takes a long time to fix and master to be able to compete with the changed swing. With this method and the apparatus, players are given the "feel" instantly if they are not in the correct position and the player can memorize the "feel", not only with muscle memory, but with their brain actually controlling the signals to the muscles. This "feel" is important because the player themselves cannot see themselves reproducing the swing without video recording their swing. Even with the video recordings, they constantly have to adjust where to put the arm or what angle the arm has to be in by watching and repeating constantly which is more time consuming. The apparatus helps position the arms to the correct position instantly by limiting too much movement, keeping adequate space in between body parts, or not allowing them to touch the ball with a certain body.

Lastly, the classic tennis style and teaching methods decades ago, had to limit the fast and powerful swings because it was played with wooden rackets. The wooden rackets had too much flex so the players swinging the wooden rackets had to slow down the racket speed and was played with different technique and swings. In modern tennis, the racket technology has made the rackets much stiffer than the wooden rackets in the past, thus players are able to use powerful fast swings to hit the ball. This makes the arm positioning and using the correct technique more important to hit with accuracy. The method and the apparatus can aid in teaching and help players to "feel" how to put the arms in the correct position to create faster racket speed.

SUMMARY OF THE INVENTION

The present invention advantageously fills the aforementioned deficiencies by using the invention and method configured to be placed on a tennis players arms to maintain the tennis players arms in the proper position throughout a tennis swing, in which helps to fix most common mistakes of nearly all the swings and shots used in tennis including one handed forehand, two-handed forehands, two-handed backhand, forehand and backhand volley, one handed backhand, one-handed backhand slice, overhead, and the serve.

The present invention comprises a ball about as big as a tennis ball and a velcro strap attached or going through the ball, which is made up of the following components a ball sized about as big as a tennis ball and a velcro or a rubber elastic strap. The strap passes through the middle of the ball to prevent the ball from moving on the arms or falling out after a swing. The method of positioning the apparatus is to be utilized with the apparatus.

The present invention may also have one or more of the following:

The material of the ball can be foam, plastic, rubber or any kind of relatively solid resilient material to have enough form under pressure.

The ball can be in any shape and size that provides enough spacing between the limb and the body part according to the size of the people using the apparatus. For example: half a ball that contours the arm or a rounded rectangular shape that contours the arm to have more comfort or a smaller sized ball for children.

The ball can be made of same or different material on different halves to prevent too much friction on the skin.

Cover or material for the ball to be able to take off and wash and to cause less friction when swinging.

The ball or object can be made of a material that is inflatable to fit most people's needs and sizes and contours to one's body and arm.

The type of strap used to hold the ball or object in place can be of any material (rubber, neoprene, fiber, cloth, polyester, polyurethane, nylon and or synthetic weave). The material or object that holds the strap can be of any device that does not allow the strap to be undone easily and is fastened. For example: a strap with a buckle at the end can also fulfill the role of the Velcro strap.

The strap does not need to pass through the object/ball in order for the apparatus to be functional as long as the strap is secured on the object/ball. The pass through method is preferred because of the ability to slide the object/ball on the strap.

A flexible rubber strap to fit more players with different size arms and body parts.

The strap can also be just a strap with a lump or objects to fill in a pocket of the strap to imitate the spacing object.

There can be a device, clip, or any kind of mechanism on the ball/object or strap to hold the ball/object in position on the strap to prevent it from sliding easily on the strap while using the apparatus during a swing and positioning the ball/object.

The strap can be removed from the ball/object to wash or replace with a new strap.

The method of ball placement can vary slightly between different body types. The height, width, and weight are some factors. The concept of the method of placing an object to restrict movement, restrict from touching, or holding the arms in place does not change.

The present invention device is unique when compared with other known aids and solutions because the present invention provides: (1) self-feedback to the user; (2) because of the strap on the ball, it does not drop and roll on the court after the swing, potentially causing injury; (3) takes no time to put the ball back into position for the repeated swing; (4) ease of use (self-applied); (5) the user the ability to rally with a partner with the apparatus; and (6) aids in correction of many different swings and shots.

Similarly, the associated method is unique in that it: (1) helps the player position the ball on a strategic body part specifically for tennis swing; (2) provides specific position in tennis to create the most natural movement to properly swing the racket for different shots; (3) aids in correction of many different swings and shots; (4) aids large groups, schools, or academies to be able to teach and or fix swings in a consistent way to all the players; and (5) aids to self-teach or fix how to hit many of the shots used in tennis.

To inventor's knowledge, there are no other prior art similar to the present invention nor the method for tennis. If there is any inventions similar to the present invention, these are some of the unique qualities of the invention and method associated with the invention.

The present invention is unique in that it is structurally different from other known devices or solutions. More specifically, the present invention is unique due to the presence of: (1) Strap going through an object; (2) Velcro to hold in place; (3) one size to help with all the strokes in tennis; (4) light and small in size; (5) soft enough but solid enough to be comfortable to be held with body parts pressing on the object; and (6) does not restrict or hinder the movement of the hitting arm from the body/torso by strapping to the main body/torso.

Furthermore, the process associated with the aforementioned invention is likewise unique and different from known processes and solutions. More specifically, the present invention process owes its uniqueness to the fact that it: (1) helps with nearly every stroke in tennis; (2) informs the specific positioning of the apparatus; (3) informs when and how to use the apparatus; (4) is simple to understand even without explaining in words.

Among other things, it is an object of the present invention to provide a method and apparatus configured to be placed on a tennis players arms to maintain the tennis players arms in the proper position throughout a tennis swing that does not suffer from any of the problems or deficiencies associated with prior solutions.

It is still further an object of the present invention to help coaches teach and fix swings of a large group, schools, and or academies by having consistency in their teaching and fixing method.

Further still, it is an object of the present invention to have a global standard to help teach and fix common symptoms of tennis swings.

An aspect of the invention provides a tennis swing training apparatus, which comprises a spherical member and a strap member.

The spherical member has a connection device, and the strap member goes through the spherical member through a hole or slit provided in the spherical member. The strap member is configured to be worn on a user's arm so as to prevent the spherical member from dropping, moving, or coming off.

The spherical member is configured to be placed between the user's arm and torso during a tennis swing, so as to provide feedback about the tennis swing to the user through touching or squeezing of the spherical member on one or more portions of the user's body, and alert the user so that the user corrects the tennis swing during the tennis swing.

The spherical member may be fabricated of rubber, plastic, polyurethane, or their combination, to which it is not limited.

Another aspect of the invention, a tennis swing training apparatus comprises a resilient ball and a strap member.

The resilient ball has a connection device, and a strap member goes through the resilient ball through a hole or slit provided in the resilient ball, the strap member being configured to be worn on a user's arm so as to prevent the resilient ball from dropping, moving, or coming off.

The resilient ball is configured to be placed between the user's arm and torso during a tennis swing, so as to provide feedback about the tennis swing to the user through touching or squeezing of the resilient ball on one or more portions of the user's body, and alert the user so that the user corrects the tennis swing during the tennis swing.

The resilient ball may be fabricated of foam or sponge. The foam or sponge may have a substantially rigid outer surface.

The resilient ball may be configured to slide on the strap member with substantial force so as to accommodate different arm sizes of the user.

The spherical member may be fabricated with a resilient material on one half of the member, and the other half of the spherical member may be fabricated with a contouring material so as to prevent movement of the spherical member when the user's arm muscles flex during the swing. The contouring material is placed towards the user's arm to prevent any discomfort when the apparatus is worn on the bare skin. The resilient material on the other half of the member is facing the opposite way of the arms to help the user feel the apparatus on the body when the swing is practiced.

In the above two aspects of the invention, the strap member may be fabricated of rubber, neoprene, fiber, cloth, polyester, polyurethane, plastic, nylon, synthetic weave, or combination thereof.

The tennis swing training apparatus may be configured to stabilize shoulder, elbows, and arms so as to use a wrist properly which controls a face of a racket on contact of a tennis ball.

The spherical member may have a substantially rigid outer surface.

The spherical member may be configured to slide on the strap member with substantial force so as to accommodate different arm sizes of the user.

Another aspect of the invention provides a tennis swing training apparatus comprising a spherical member fabricated of resilient material and a strap member extending from two portions of the spherical member and making a closed ring shape, so that the strap member is configured to be worn on an arm of a user so as to prevent the spherical member from dropping, moving, or coming off during a tennis swing, and the spherical member is configured to be placed between the user's arm and torso during a tennis swing, so as to provide feedback about the tennis swing to the user through touching or squeezing of the spherical member on one or more portions of the user's body, and alert the user so that the user corrects the tennis swing during the tennis swing.

The strap member may be detachable from the spherical member.

Alternatively, the strap member may be fixed to the spherical member, and the strap member comprises a first strap portion, a first fastener, a second strap portion, and a second fastener.

The first strap portion extends from a first portion of the spherical member, and the first fastener is provided at an end of the first strap portion.

The second strap portion extends from a second portion of the spherical member, and the second fastener is provided at an end of the second strap portion and being configured to be fastened detachably to the first fastener.

The first and second strap members fastened to each other through the first and second fasteners are configured to be worn on an arm of a user so as to prevent the spherical member from dropping, moving, or coming off during a tennis swing, so that the spherical member is configured to be placed between the user's arm and torso during a tennis swing, so as to provide feedback about the tennis swing to the user through touching or squeezing of the spherical member on one or more portions of the user's body, and alert the user so that the user corrects the tennis swing during the tennis swing.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

The priority to U.S. Provisional Patent Application No. 62/196,923 by the inventor, filed Jul. 25, 2015 is incorporated by reference herein for any and all purposes.

Figure 1:
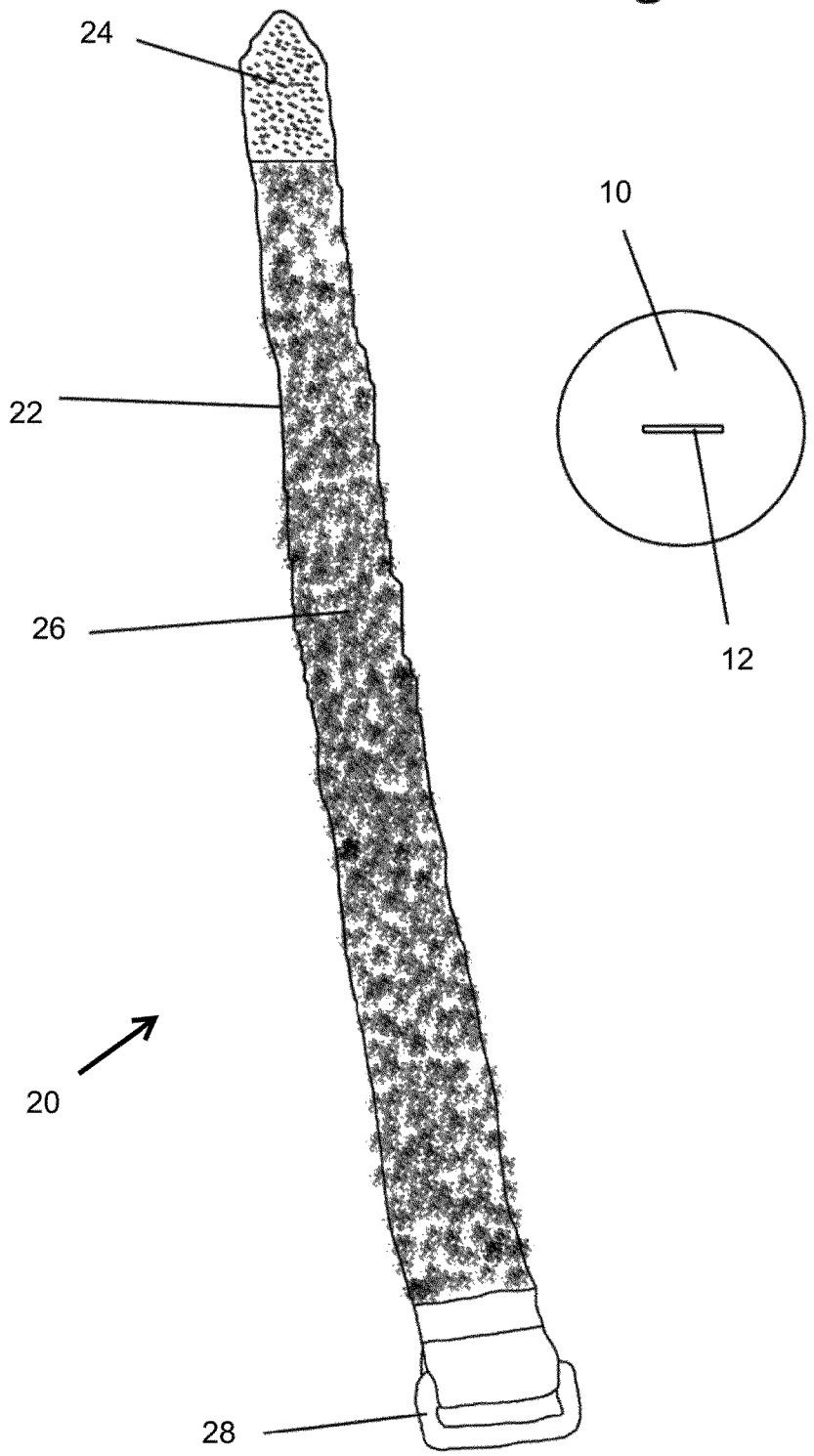
FIG. 1 is a perspective view showing a strap and a ball disassembled according to an embodiment of the invention.
Figure 2:
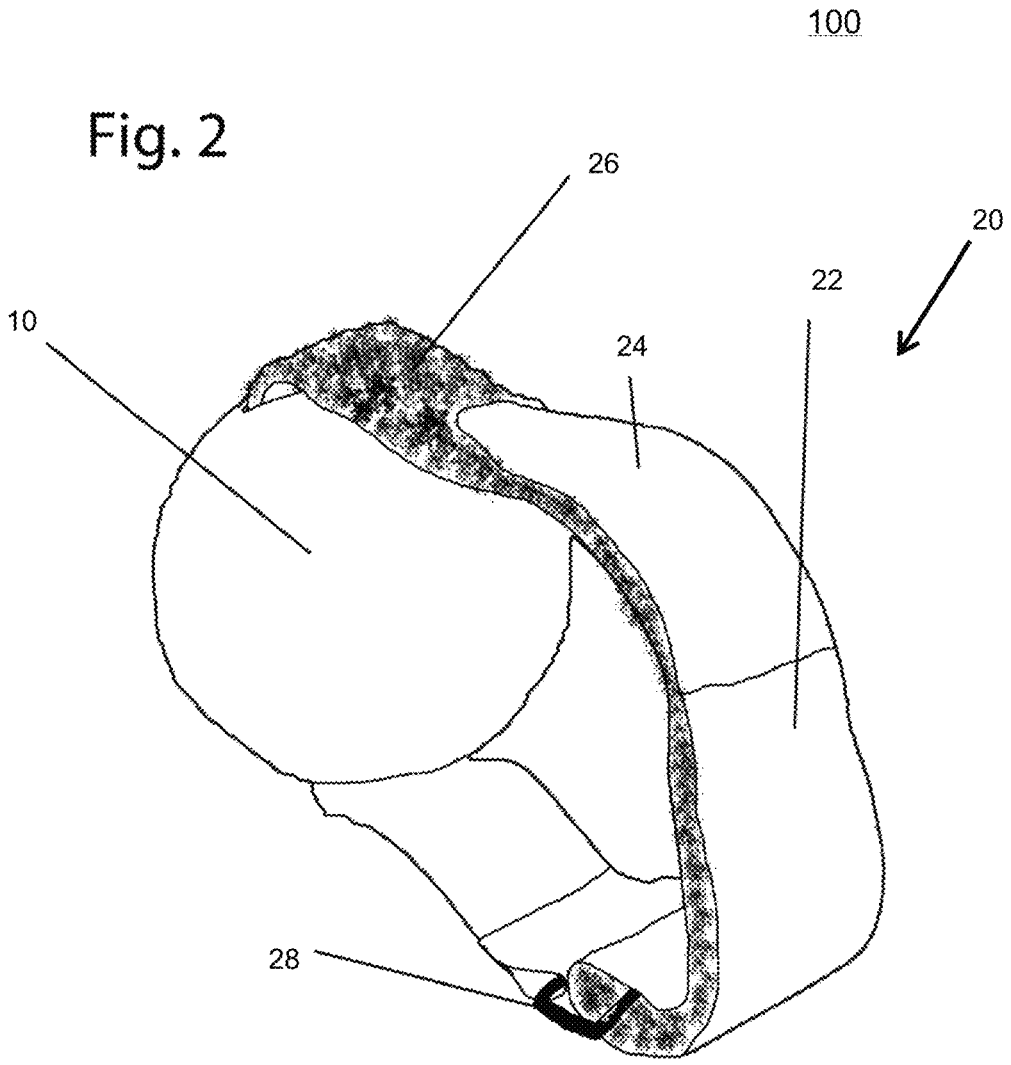
FIG. 2 is a perspective view showing the strap fastened to the ball of FIG. 1.
Figure 3A:
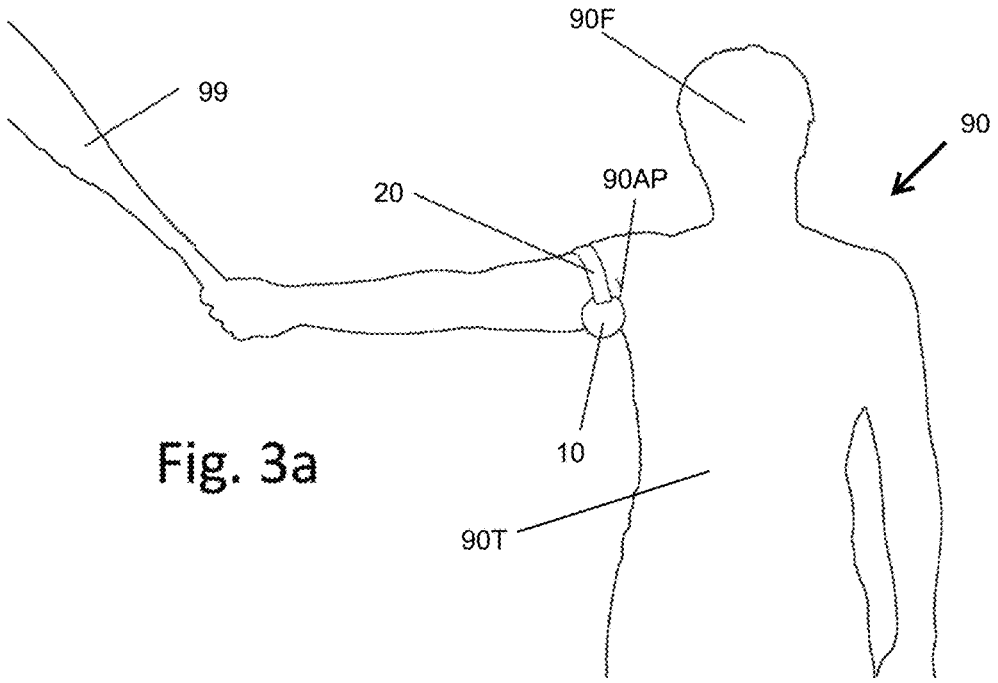
FIG. 3*a* is a front view showing a tennis swing training apparatus worn by a user in one handed forehand.
Figure 3B:
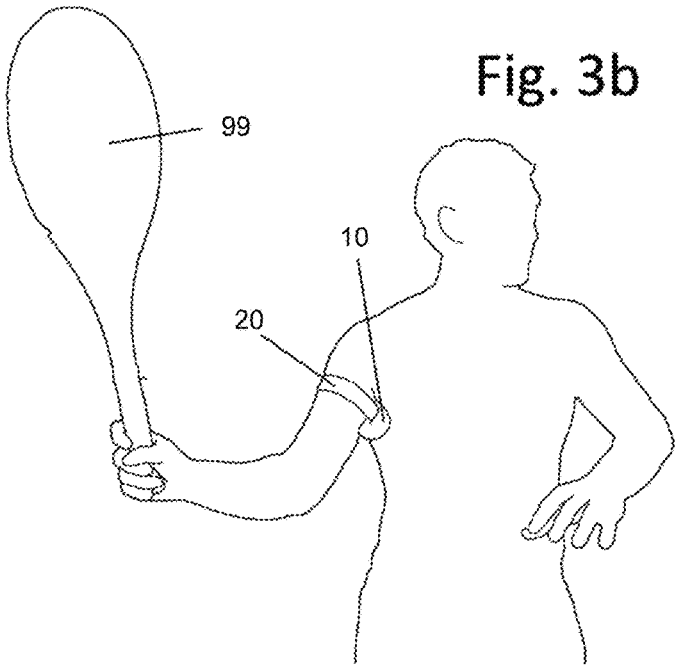
FIG. 3*b* is a side view showing the backswing of the one handed forehand from the side view with the correct positioning of the apparatus.
Figure 3C:
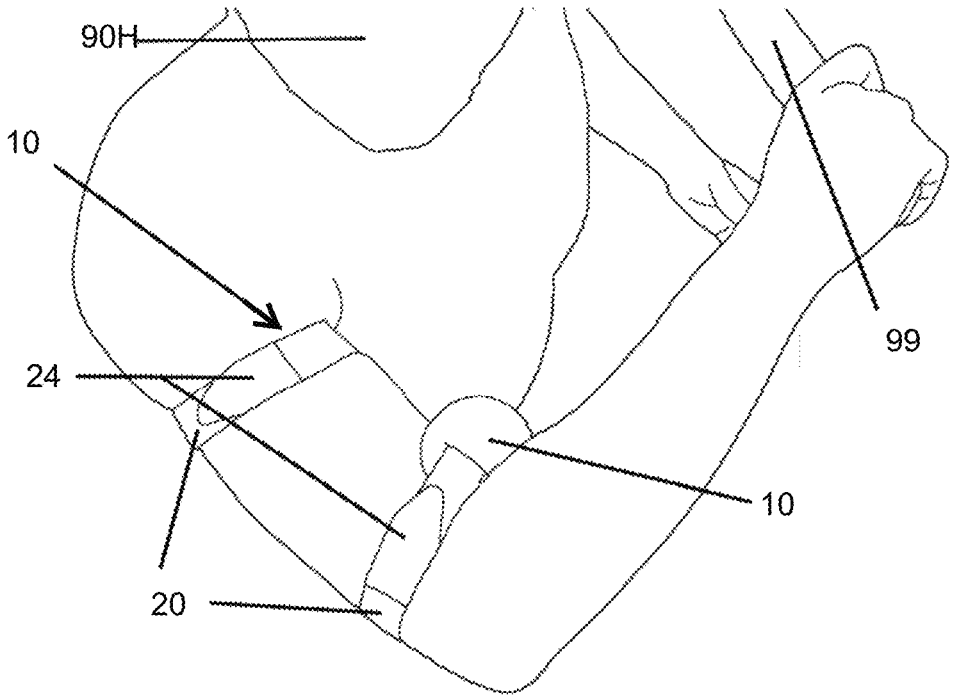
FIG. 3*c* is a top view showing a finish of one handed forehand and a correct position of a tennis swing training apparatus according to an embodiment of the invention.
Figure 4A:
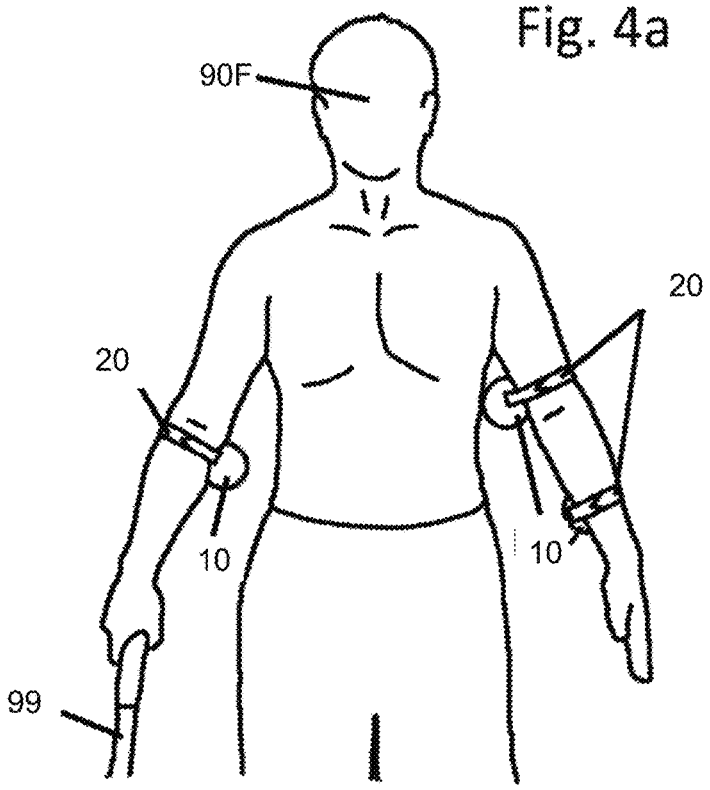
FIG. 4*a* is a front view showing a correct position of a tennis swing training apparatus in two handed backhand according to an embodiment of the invention.
Figure 4B:
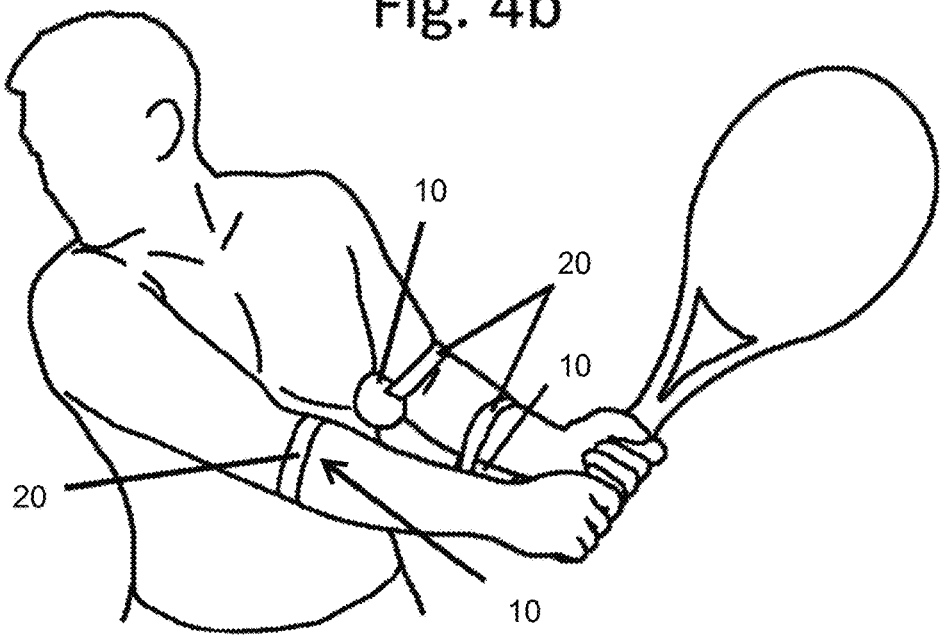
FIG. 4*b* is a side view showing a backswing of two handed backhand with a correct positioning of a tennis swing training apparatus according to an embodiment of the invention.
Figure 4C:
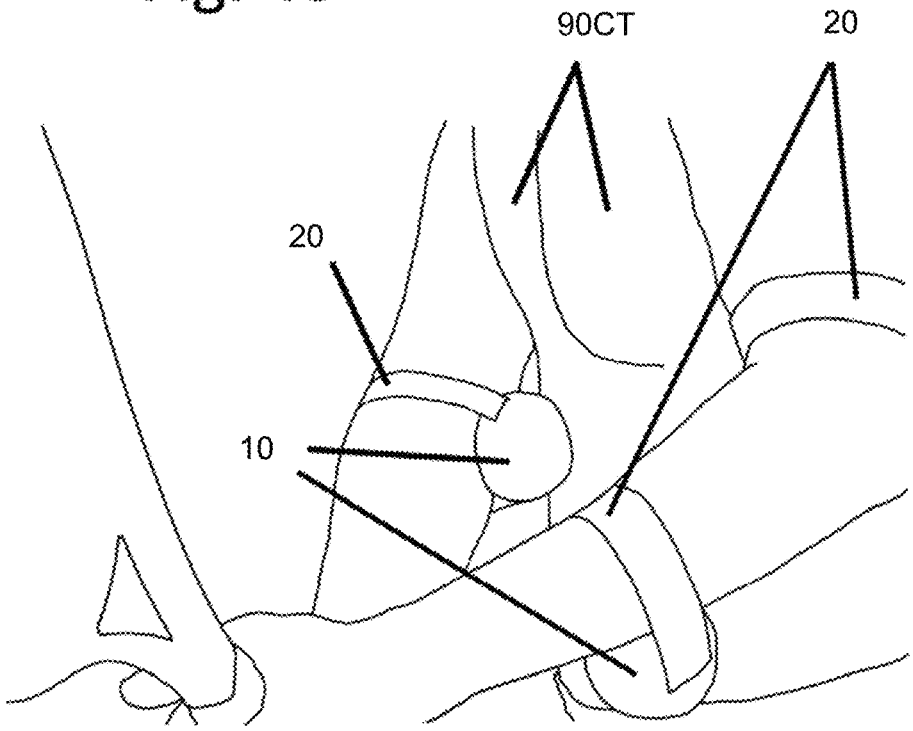
FIG. 4*c* is a zoomed-in rear view showing a backswing of two handed backhand with a correct positioning of a tennis swing training apparatus according to an embodiment of the invention.
Figure 4D:
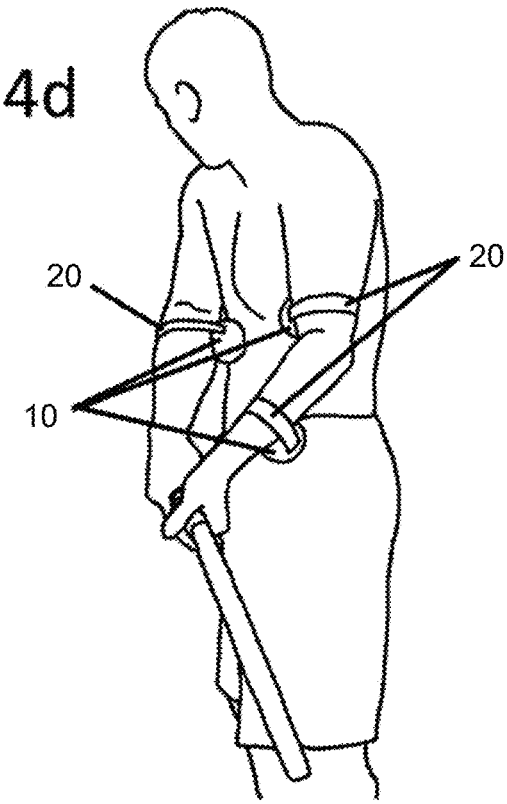
FIG. 4*d* is a rear view showing a backswing of two handed backhand with a correct positioning of a tennis swing training apparatus according to an embodiment of the invention.
Figure 5A:
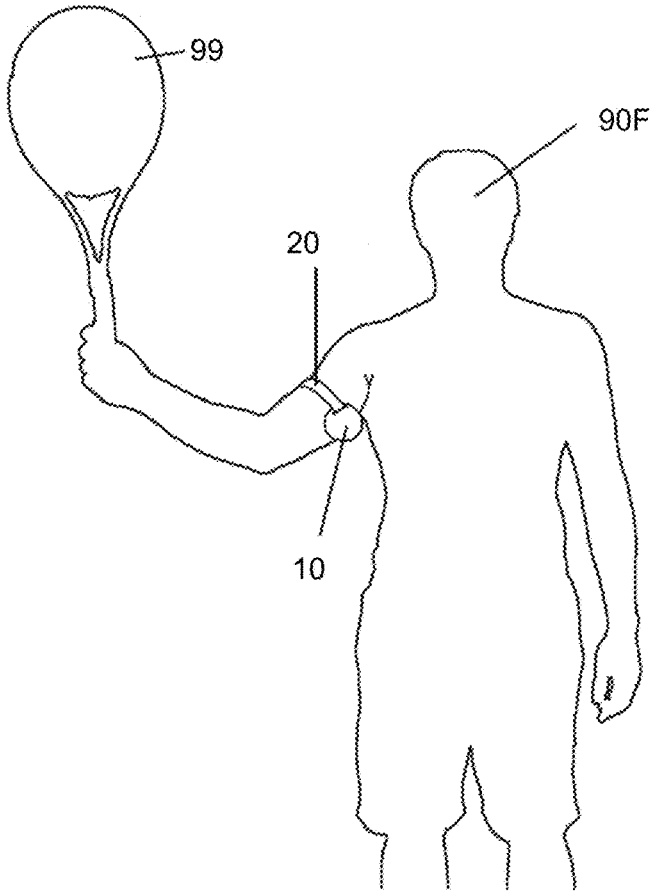
FIG. 5*a* is a front view of showing a correct position of a tennis swing training apparatus of volleys according to an embodiment of the invention.
Figure 5B:
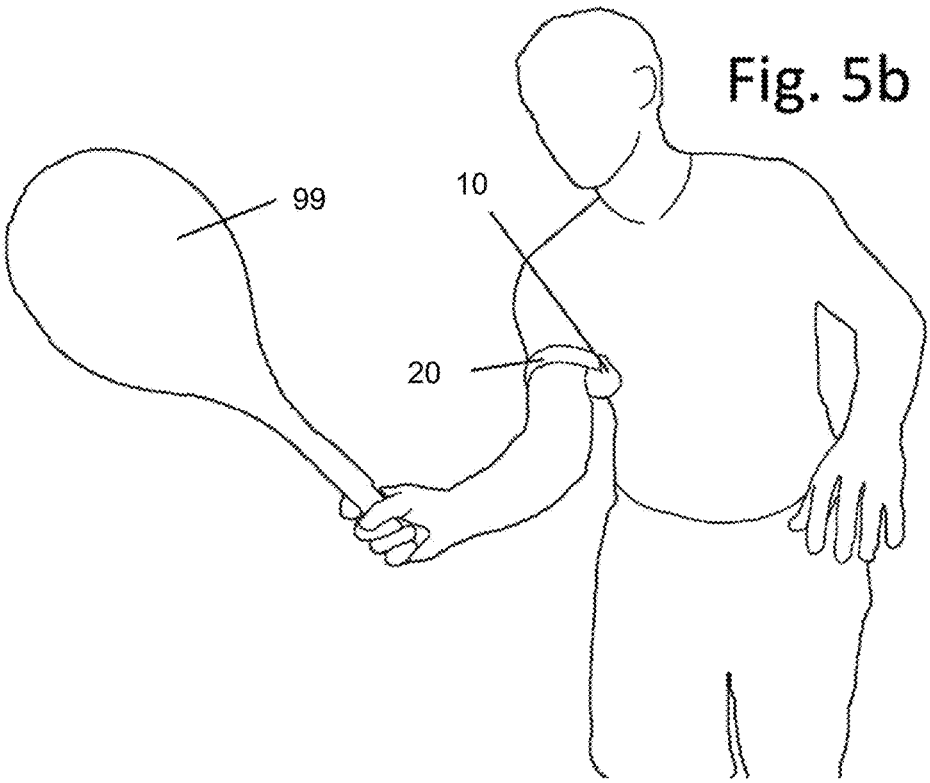
FIG. 5*b* is a front view showing a backswing of a forehand volley at medium height with a correct positioning of a tennis swing training apparatus according to an embodiment of the invention.
Figure 5C:
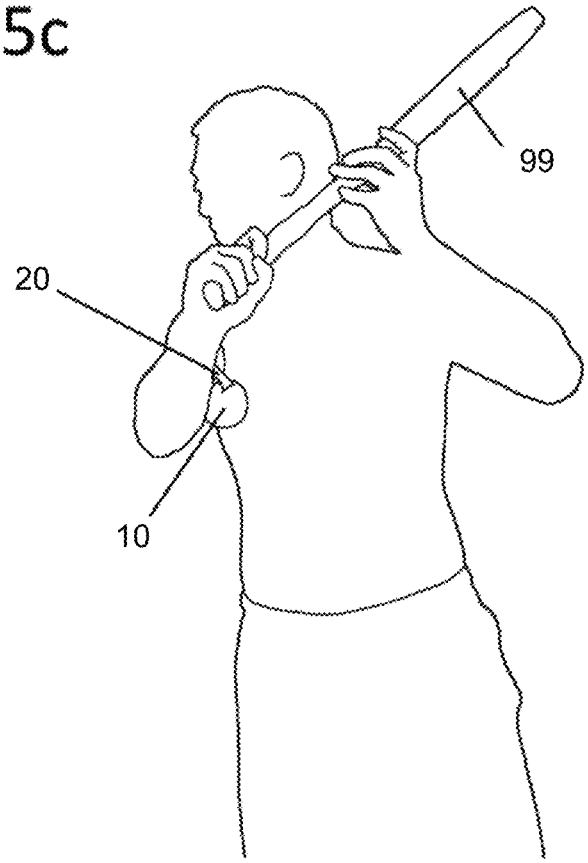
FIG. 5*c* is a side view showing a backswing of a backhand one handed volley with a correct positioning of a tennis swing training apparatus according to an embodiment of the invention.
Figure 6A:
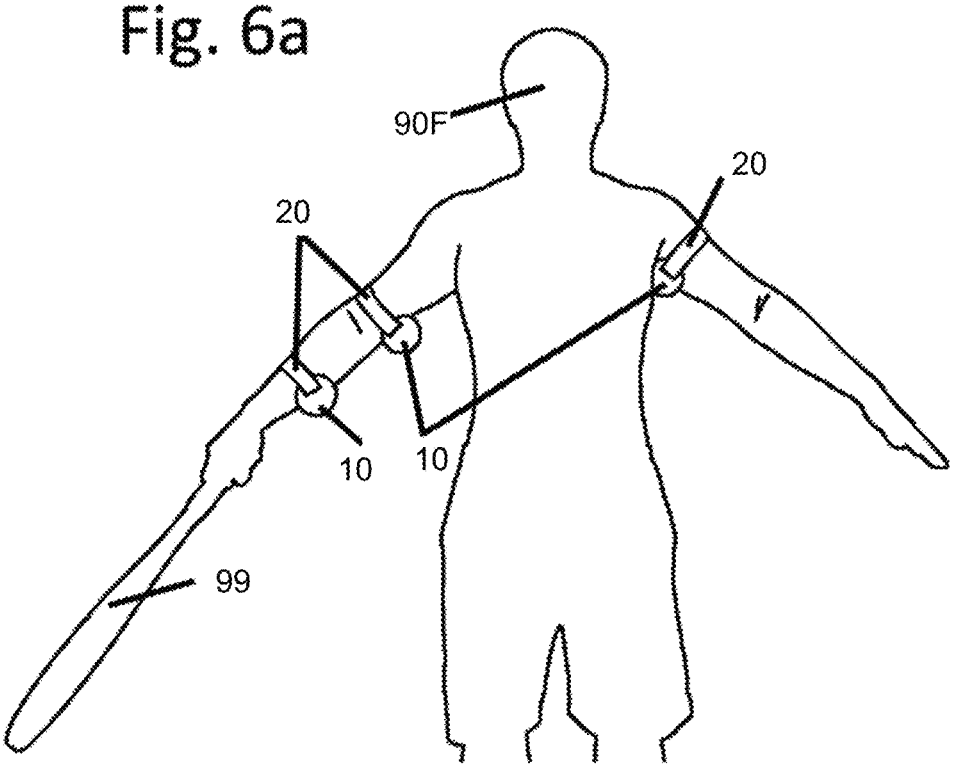
FIG. 6*a* is a front view showing a correct position of a tennis swing training apparatus of one handed backhand according to an embodiment of the invention.
Figure 6B:
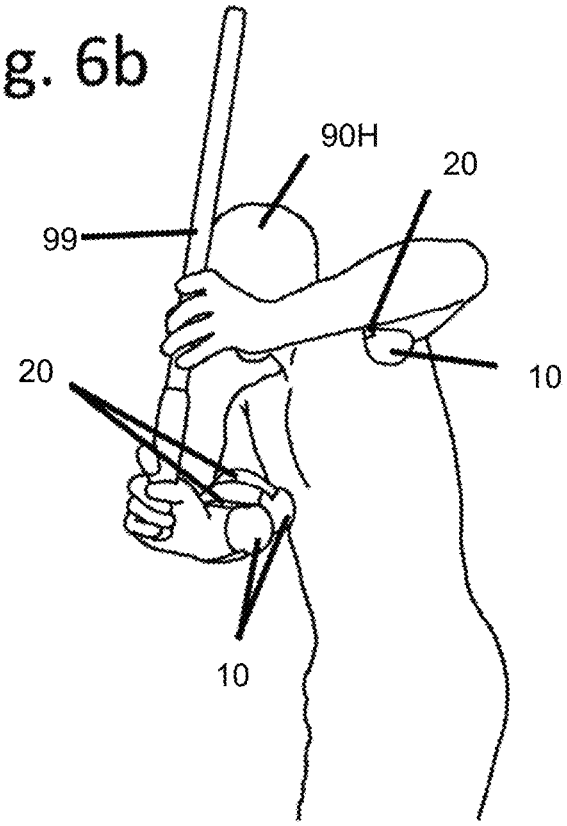
FIG. 6*b* is a rear view showing a backswing of one handed backhand with a correct positioning of a tennis swing training apparatus according to an embodiment of the invention.
Figure 6C:
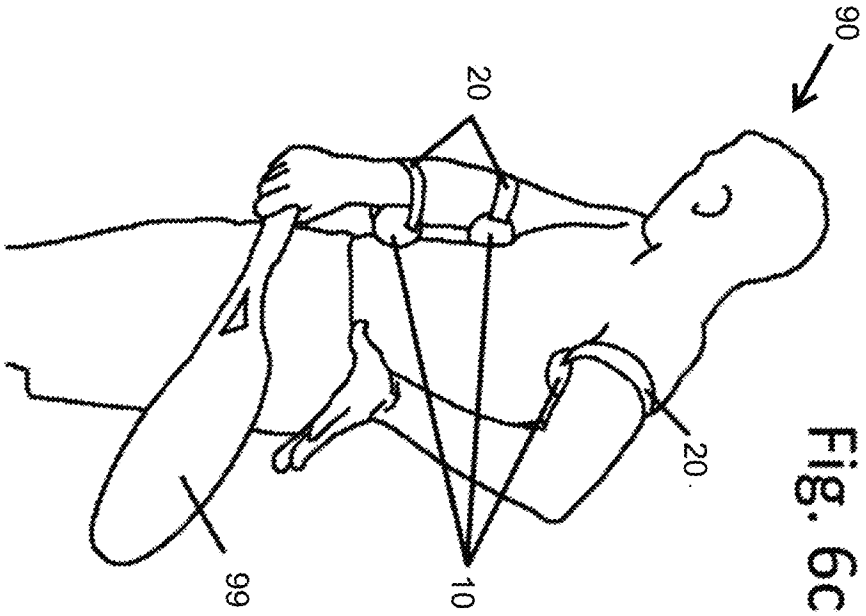
FIG. 6*c* is a rear view showing a tennis swing training apparatus on a right forearm touching a stomach area while taking one handed backhand backswing before contact according to an embodiment of the invention.
Figure 7A:
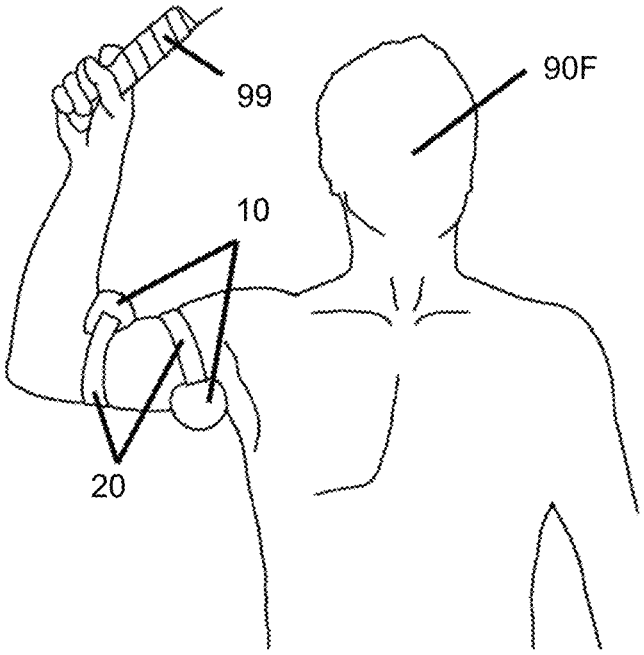
FIG. 7*a* is a front view showing a correct position of a tennis swing training apparatus for serve and overhead/smash on the hitting arm according to an embodiment of the invention.
Figure 7B:
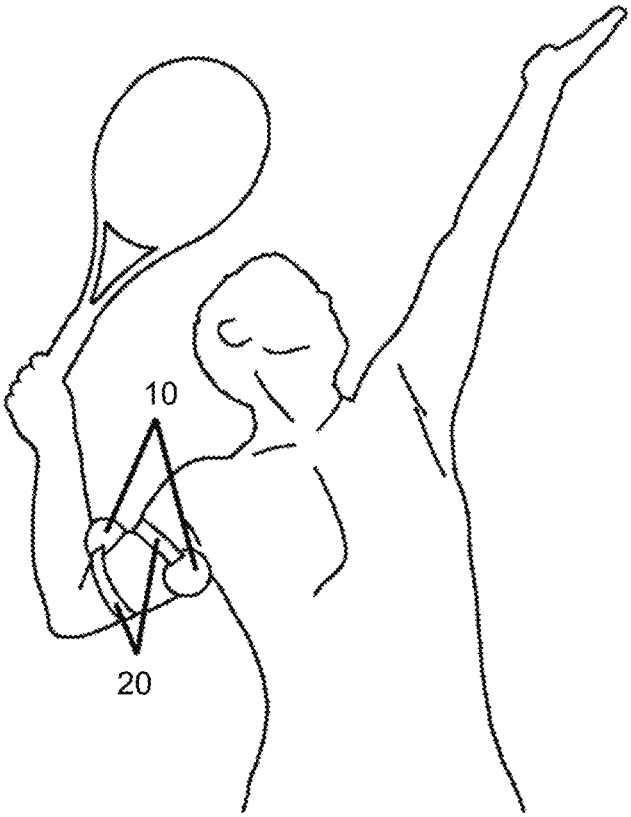
FIG. 7*b* is a side view showing a trophy position of serve and overhead/smash with a correct position of a tennis swing training apparatus for the according to an embodiment of the invention.
Figure 7C:
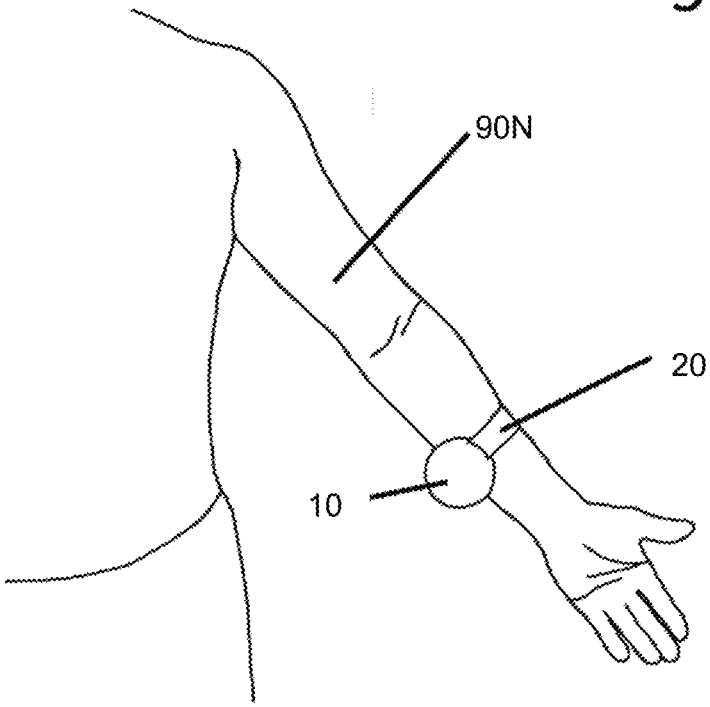
FIG. 7*c* is a front view showing a correct position of a tennis swing training apparatus for a serve on the non-hitting arm according to an embodiment of the invention.
Figure 7D:
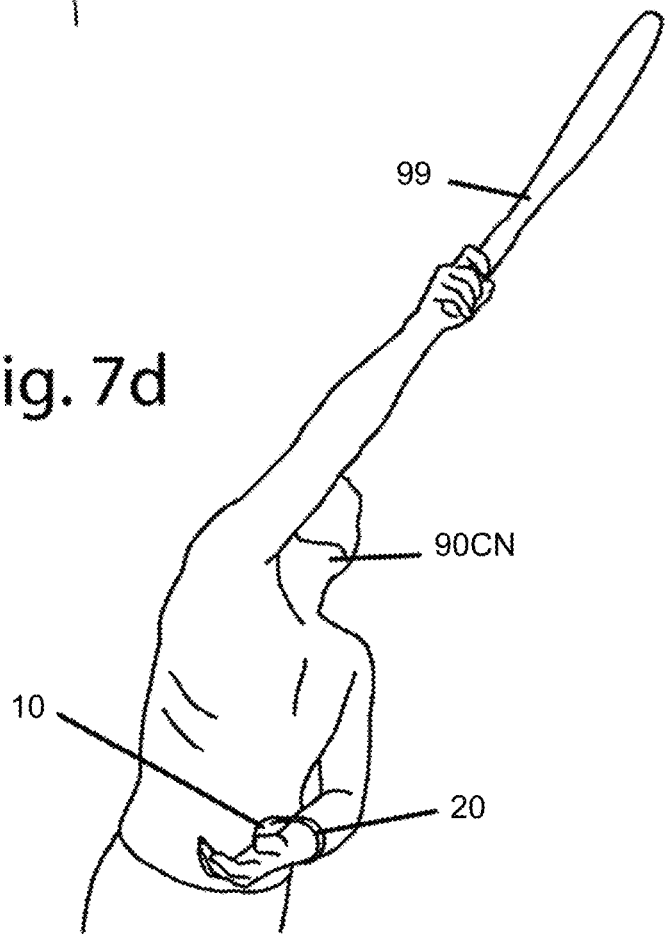
FIG. 7*d* is a side view showing a tennis swing training apparatus touching a belly button area on a contact of a serve according to an embodiment of the invention.
Figure 8A:
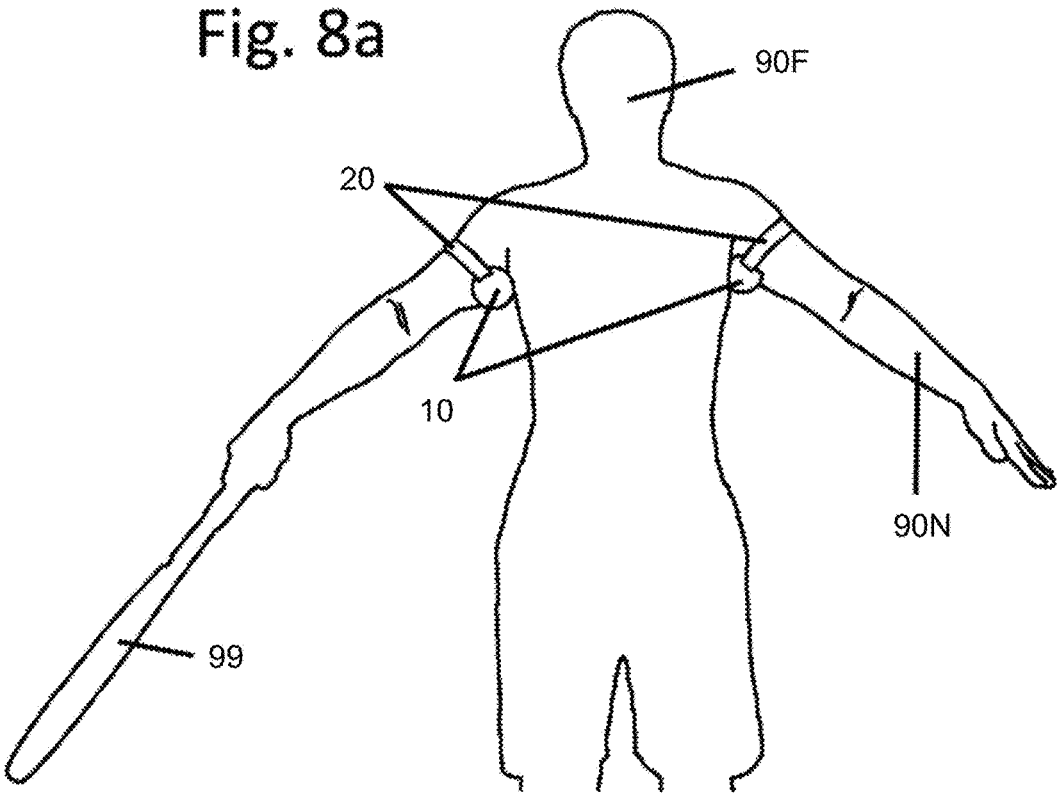
FIG. 8*a* is a front view showing a correct position of a tennis swing training apparatus of one handed backhand slice according to an embodiment of the invention.
Figure 8B:
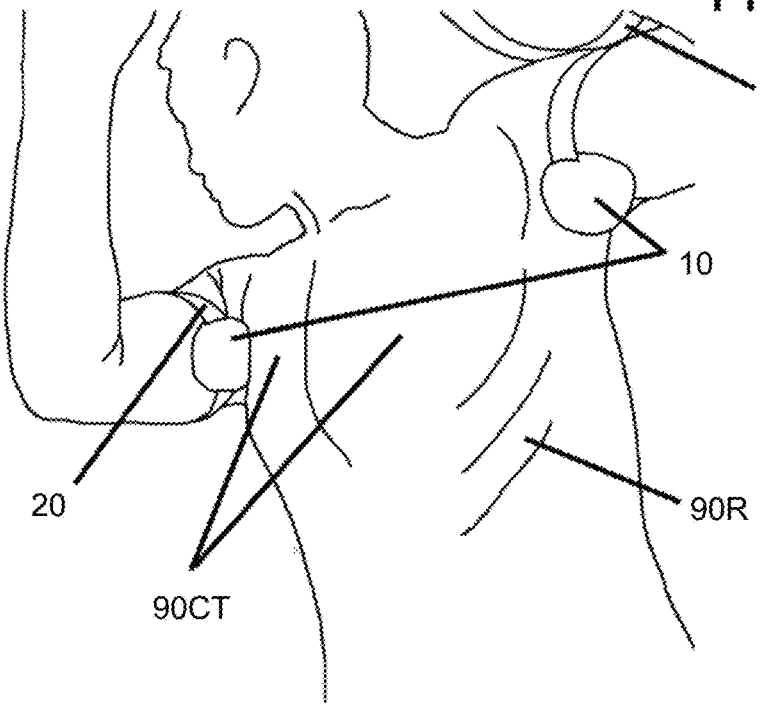
FIG. 8*b* is a zoomed-in rear view showing a backswing of one handed backhand slice with a correct positioning of a tennis swing training apparatus according to an embodiment of the invention.
Figure 8C:
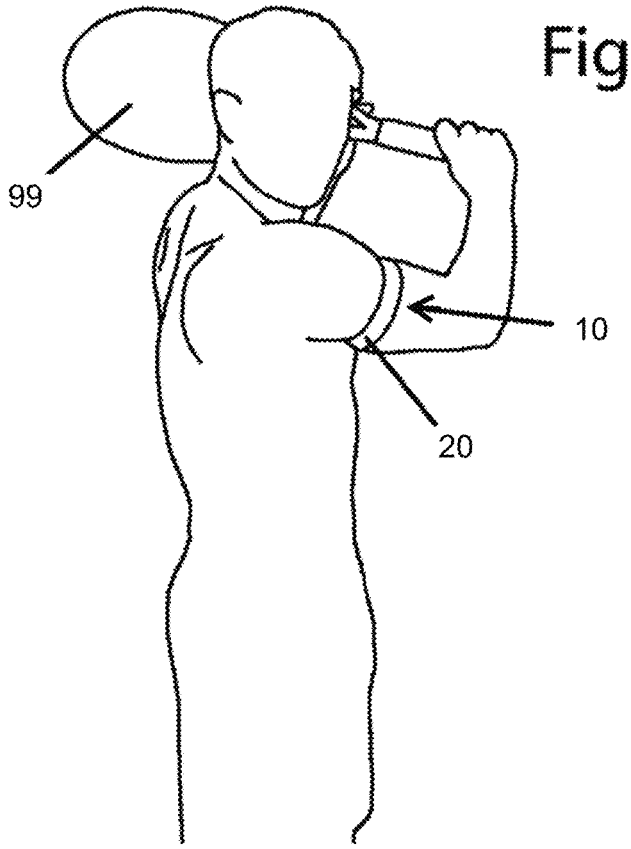
FIG. 8*c* is a front view showing a backswing of one handed backhand slice with a correct positioning of a tennis swing training apparatus according to an embodiment of the invention.
Figure 8D:
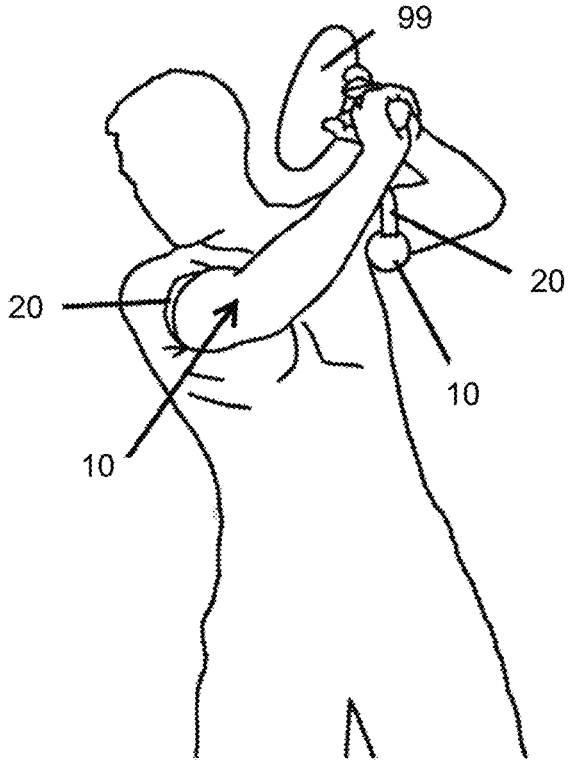
FIG. 8*d* is a side view showing a backswing of one handed backhand slice with a correct positioning of a tennis swing training apparatus on the left arm according to an embodiment of the invention.

FIGS. 1 and 2 show a tennis swing training apparatus according to an embodiment of the present invention, and FIGS. 3*a* through 8*d* show how to use one or more tennis swing training apparatuses according to an embodiment of the present invention.

The present invention is directed to provide a method and apparatus configured to be placed on a tennis players arms to maintain the tennis player's arms in the proper position throughout a tennis swing.

In its most complete form, the present invention apparatus is made up of the following components:

Rubber or a foam ball size of a tennis ball that is slip resistant when dry or wet with Velcro strap going through the middle of the ball. The ball cannot be moved too easily on the strap or it has to have a mechanism to hold the ball in place on the strap. The strap cannot be on the edge of the ball since the ball will move around too much when reproducing the tennis swing. The strap cannot pass through or be on the bottom edge of the rubber ball since the ball will move around the strap too freely with not enough support from the strap. The strap cannot pass through or be on top edge of the ball since the ball will move around side to side and will dangle too much because it will not have enough support from the strap. The ball or the object can be positioned by sliding the strap on ball/object to fit and position the ball according to a person's needs.

The strap that passes through the ball will be 0.5 inch wide or wider to have enough support when the ball is strapped onto the arm or body part and to not cause any discomfort or pain because of the strap being too thin. The strap length will be no less than 6 inches long in order for it to accommodate proper sizing to fit any human arm. The strap will have a loop at the end for the strap to be fastened with velcro.

The method and problems that it solves with the apparatus are follows:

1. One handed forehand (FIG. 3*a*, 3*b*, 3*c*): The apparatus is placed underneath the right armpit to up to 2 inches below the armpit depending on the need and strapped to the right arm for right handed players and left arm for the left handed one handed forehands. The player is to feel the apparatus on both his/her arm and the main torso/body while practicing their normal swing from their backswing to the finish while letting the ball go as they complete their swing from the contact to the finish of the swing. The coach asks the player to take the biggest possible circular swing with the ball still felt on the torso and the arm. The apparatus position can be changed to a lower part of the upper arm (not recommended to put near the elbow joint as it restrict too much movement of the shoulder) depending on how fast the ball is to shorten the backswing to aid in fast paced balls or if the player is a child or small adult.

a) It provides enough space for the arm to move freely during the swing while the player can still feel the ball on the side of their main torso/body.

b) It provides feedback on the side of the main torso/body to feel the apparatus as the player takes a backswing and swings forward to keep their racket and arm in the correct position.

c) By holding the ball or lightly squeezed throughout the swing, the player can fix backswings that are too big.

d) By holding the ball or slightly squeezing throughout the swing, the player can fix the side spin generated by their swing from an outside in swing to an inside out loop and produce topspin. It also enables the player to hit the outside of the ball and hit crosscourt easily.

e) By holding the ball or slightly squeezing throughout the swing, the elbow is stabilized to create efficient power and stabilizes the contact when the ball is struck with the racket.

f) By holding the ball or slightly squeezing throughout the swing, the player can fix the timing to hit the ball in front of the body.

g) By holding the ball or slightly squeezing throughout the swing, it positions the arm into place when they are having trouble positioning the arm on the backswing since beginners tend to move the arm, shake, or move up and down when they are moving.

h) By holding the ball or slightly squeezing throughout the swing, it prevents the elbow to be too close or too far away from the main torso/body, hence being in the correct position to hit the tennis ball.

i) By holding the ball or slightly squeezing throughout the swing, it fixes too small of a backswing and not getting enough racket speed as the racket comes out to the contact point of the tennis ball. Make sure the player makes the biggest swing possible without lifting too much of the elbow to not be able to feel the ball on the side of the torso/body. It also helps them to hit outside of the ball to hit crosscourt easier and not be late on the contact point to the tennis ball.

j) By holding the ball or slightly squeezing throughout the swing, the kinetic chain from the shoulder joint to the elbow is much easier for the player, hence the player can generate efficient power when hitting the tennis ball.

k) By holding the ball or slightly squeezing throughout the swing, the center point of the swing is more focused on the elbow joint to create a faster swing than swinging from the larger joint of the shoulder. Not only does it generate more racket speed, it helps the player to have a smooth loops swing from the elbow joint. For this problem, the apparatus can be placed next to the middle of the upper arm in between the bicep and the triceps towards the torso/body.

l) By keeping the apparatus squeezed on the backswing to the contact, it helps the racket to be more perpendicular to the ground on the contact by keeping the elbow tucked in when contacting the ball. Players that have a tendency to hit on top of the ball and generate unnecessary spin can be corrected.

m) Another apparatus can be used on the hitting arm on the elbow crease to keep the player from finishing with their arms going around their neck, which is another deficiency in the swing and causes the racket to be less explosive from the backswing to the finish.

2. Two handed backhand (FIG. 4*a*, 4*b*, 4*c*, 4*d*): The first apparatus is strapped on the left arm (for right handed player) above the inner part of the elbow joint (2.5 inches or 6.5 cm above starting from the inner elbow bone) in between the bicep and the triceps towards the body/torso. Second apparatus is strapped on the mid-section of the left forearm right next to the ulna bone (inner side of the ulna bone towards the body). Third apparatus is strapped on the inside of the forearm just below the elbow joint towards the stomach of the right arm. For left handed players, the apparatus is strapped on the opposite arms. The coach asks the player to take the left elbow straight back as far as possible until the apparatus limits the left arm from going back even further (front side of the ribcage right below the chest) and squeezing apparatus on the body if it comes off the body/torso easily while taking the backswing. The apparatus above the left elbow should be kept on the body and limits the player to lift the elbow up. The apparatus on the right arm is asked to touch past the midline of the stomach area right away as the player takes the racket back. Before the player makes contact with the oncoming tennis ball, the player is asked to touch the body (left hip area) with the apparatus on the left forearm to promote racket drop before making contact with the oncoming ball. The objective of the left apparatus above the elbow is to have the center point of the circular motion on the swing to be felt from the elbow. The apparatus on the right arm is placed on the upper inner forearm close to the elbow joint. The objective of the right apparatus, even though the left arm should be dominant is to help with the rotation of the right shoulder (shoulder turn) and to generate faster racket speed on the way to hit the ball by generating a catapult/slingshot effect. The objective of the apparatus on the left forearm is to have the player drop the racket tip below the ball to generate a low to high swing with the racket tip and generate adequate topspin and height of the ball path. The apparatus's should not be kept touching any part of the body on the finish. The left elbow is stabilized by the apparatus in which the apparatus limits the left arm going back too far and the player is to keep the apparatus on the body/torso from lifting the left arm or elbow.

a) It provides enough space for the arms to move freely during the swing while the player can still feel the ball on the side of their main torso/body.

b) It provides feedback on the side of the main torso/body to feel the ball as the player takes a backswing and swings forward to keep their racket and arm in the correct position.

c) By holding the ball or lightly squeezing throughout the swing, the player can fix backswings that are too big.

d) By holding the ball or slightly squeezing throughout the swing, the player can fix the side spin generated by their swing from an outside in swing to an inside out loop and produce topspin. It also enables the player to hit the outside of the ball and hit crosscourt easily.

e) By holding the ball or slightly squeezing throughout the swing, the main arms elbow (left elbow for right handers) is stabilized because it is close enough to the body/torso to create efficient power and stabilizes the contact when the ball is struck with the racket.

f) By holding the ball or slightly squeezing throughout the swing, the player can fix the timing to hit the ball in front of the body.

g) By holding the ball or slightly squeezing throughout the swing, it positions the arm into place when they are having trouble positioning the arm on the backswing since beginners tend to move the arm, shake, or move up and down when they are moving.

h) By holding the ball or slightly squeezing throughout the swing, it prevents the elbow to be too close or too far away from the main torso/body, hence elbow and arms being in the correct position to hit the tennis ball.

i) By holding the ball or slightly squeezing throughout the swing, it fixes too small of a backswing and not getting enough racket speed as the racket comes out to the contact point of the tennis ball. Make sure the player makes the biggest swing possible without lifting the left elbow to not be able to feel the ball on the side of the torso/body and the apparatus on the right arm to be touching past the middle half the of the stomach to generate racket speed. It also helps them to hit outside of the ball to hit crosscourt easier and not be late on the contact point to the tennis ball.

j) By holding the ball or slightly squeezing throughout the swing, the center point of the swing is more focused on the elbow joint to create a faster swing than swinging from the larger joint of the shoulder. Not only does it generate more racket speed, it helps the player to have a smooth loop swing from the elbow joint.

k) The apparatus on the left forearm helps players to hit more consistently with topspin and able to create height on the ball to make it easier to clear the net.

3. Volleys (FIG. 5*a*, 5*b*, 5*c*): The apparatus is strapped on the high upper arm on the inner side in between the bicep and the triceps of the hitting arm (on the edge of the inner bicep). The player is then asked to hit the volley with the apparatus touching and holding with the arm towards the body/torso (upper chest closest to the apparatus) then coached to move the racket with the wrist locked back from the elbow joint to hit the tennis ball. The apparatus is strapped on the opposite side for the left handers.

a) It limits the player to take big backswing on their volleys. By limiting the backswing, it helps the player to time and hit the tennis ball with better accuracy.

b) It keeps the elbow in front of the body to stabilize the elbow to the racket. (Tucking the elbow)

c) It helps to keep the wrist locked back on the forehand volley on the backswing to the contact since the ball is hit with the elbow joint being the pivoting point of movement.

d) It helps the player to rotate the forearm to hit the tennis ball correctly on the low paced high backhand volley to get the clean feel on the contact. If the forearm is not rotated then the ball does not do what the player wants it to do.

e) It helps them both block the volley using the body's support and punch the volley with correct technique.

f) Optionally, another apparatus can be used if the players' non-hitting arm or the elbow on the backhand volley is too close to the body/torso to give both arms more balance and to be able to spread the both arms in sync while contacting and finishing the swing. For this symptom, the apparatus is strapped and positioned under the armpit of the non-hitting arm to keep space in between the torso/body and the non-hitting arm.

h) On the bump backhand volley, the apparatus is lightly squeezed by the arm and the chest area to take a big enough backswing to have support on the contact. After contacting the incoming ball, the player can be asked to take the apparatus off of the body by lifting the elbow up slightly to generate more slice on the backhand volley.

4. One handed backhand (FIG. 6*a*, 6*b*, 6*c*): The apparatus is strapped on the inside of the upper arm right above the elbow joint towards the stomach on the hitting arm and another is strapped on the mid-section of the inner forearm towards the stomach. Another apparatus is used to separate the non-hitting arm from being too close to the torso when taking the racket back by strapping the apparatus under the armpit of the non-hitting hand. While taking a backswing, the player is to set, the apparatus on the upper arm above the elbow, on the vertical midline of the stomach area when taking the racket back. The apparatus on the mid-section of the forearm of the hitting arm has to touch the left side of stomach area (edge of the ribcage on the side of the non-hitting arm) on the backswing before hitting the oncoming ball to get a proper loop swing and in order for the wrist to take the racket tip down in time before hitting the oncoming ball and generate fast racket speed. The apparatus on the non-hitting arm is strapped under the armpit of the non-hitting arm towards the torso/body. The apparatus on the non-hitting arm should be completely off of the torso/body to aid the right arm to generate a proper full loop swing. The apparatus on the hitting arm should be completely off the torso when the stroke is finished and the apparatus on the non-hitting arm is to be on the torso. As the player hits the oncoming tennis ball, the elbow on the hitting arm should snap straight and make contact with the ball. The apparatus are strapped on the opposite sides for the left handers.

a) Generates more racket speed by having the racket go in a correct loop and add more momentum to a problematic compact swing.

b) It helps the player to generate more racket speed and teaches them to use their torso by coaching the player to try to hit the apparatus with the stomach area as the racket goes back instead of the apparatus hitting the stomach area. This allows for powerful swings with the rotation of the body rather than just using the arms to generate racket speed.

c) For players that have bigger backswings, it helps them time the loop before hitting the ball.

d) It helps the racket tip to go down below the ball to a proper position forcing the wrist to be used properly on the contact of the oncoming ball.

d) It helps the player to keep the contact out in front and close to the body in order for the power to be transferred to the ball.

e) For players that have a too big of a swing, the method and the apparatus helps lessen the time between the backswing and the contact of the ball by making the player touch the stomach area with the apparatus on the backswing. It also shortens the backswing naturally since the player is asked to touch the stomach area immediately on their backswing.

f) It helps the player to keep their upper body/torso straight since the ball has to touch the stomach area which helps them hit the tennis ball with more accuracy.

g) When the player is asked to hit the apparatus on the mid-section of their forearm before the contact of the oncoming ball with their left side of the stomach area by rotating their torso, it helps with the rotation of the hips and the right shoulder to generate faster racket speed on the way to hit the ball. If the player is losing too much control then the player is asked or should try to touch the apparatus on the hitting arm to the left side of the stomach area. The racket speed can be controlled by controlling which movement is more dominant.

h) The apparatus's used on the non-hitting arm is to keep the players non-hitting arm more balance, keeping the body from rotating too much on the contact, and or keeping the non-hitting arm from dropping too much to the side of their body/torso.

5. Serve and overhead/smash (FIG. 7*a*, 7*b*, 7*c*, 7*d*): The apparatus and the method helps the player to keep the players hitting arm with the racket into correct position on the loading/trophy position of the serve, smash, or overhead. The apparatus is placed on four methods to help the positioning of the arms and body for a proper swing. First method, is to strap the apparatus on the outer lower part of the bicep on the arm with the racket in hand. The apparatus should not be strapped past the middle of the bicep towards the shoulder.

The player is coached to touch or squeeze the ball on the loading/trophy position of the serve and the smash/overhead until taking the racket up to hit the tennis ball.

The first method with the apparatus helps a players serve and smash/overhead by:

a) Positioning the forearm into position for a proper/natural swing path. (Like a good throwing motion to throw far)

b) Positioning the forearm into position for more racket speed and creating a bigger lasso effect from the elbow joint (center point) before the racket contacts the tennis ball.

c) Positioning the forearm into position for more racket speed and creating a smaller and efficient lasso effect from the elbow joint (center point) instead of the lasso movement from the shoulder joint.

d) Putting the arms into position on the trophy position which prevents the player from swinging the racket straight back and forward to hit the serve without the lasso movement.

The second method is to strap the apparatus on the armpit of the arm with the racket. The player is coached to keep the apparatus apart from touching the body/torso when the player serves from a loading/trophy position of the serve or the smash/overhead.

The second method with the apparatus helps a players serve or smash/overhead by:

d) Keeping the elbow stabilized on the swing path to minimize the up and down movement of the elbow. This helps the player to time the swing better by eliminating the time the elbow going up and down.

The third method with the apparatus helps a players serve or smash/overhead by using both the first and second method at the same time if the player has both problems of not keeping the forearm in the correct position and moving the elbow up and down on the swing.

e) The third method also helps the smash/overhead by being able to quickly set the racket into position to start moving to the ball in a speedy manner.

f) By holding the first apparatus in the middle of the bicep and the forearm, the upper shoulder muscles are activated, locked, and stabilized into proper position and the shoulder is able to generate more racket speed. If the apparatus is not in the middle of the arms then the player did not lock their shoulder enough on the trophy position of the serve or overhead. The second apparatus on the armpit stabilizes the elbow from going up and down by keeping the apparatus off of the body and holding the elbow up.

The fourth method is to strap the apparatus on the mid-section of the non-hitting forearm right next to the ulna bone (inner side of the ulna bone towards the body) and player is asked to touch the apparatus on the vertical mid line of their stomach (belly button area) as they hit the tossed ball.

g) The apparatus is used to keep the left shoulder from rotating horizontally, which pulls the right shoulder forward and makes the player hit the underside of the ball and keeps the players body from straightening out on the contact.

h) By using this method it also helps the player to reach up on the ball and hit on top of the ball. Reducing the pushing effect and helps player snap with their wrist and elbow on the contact of the serve by staying turned on the contact of the ball.

6. One handed backhand slice (FIG. 8*a*, 8*b*, 8*c*, 8*d*): The apparatus is strapped on the high upper arm on the inner side in between the bicep and the triceps of the hitting arm (on the edge of the inner bicep). Additionally, another apparatus is strapped under the armpit of the non-hitting arm to separate the arms from the torso creating space so the racket can be held up high over the non-hitting arms shoulder. The player is coached to touch and squeeze the apparatus on the high upper arm with the upper high chest area (the chest closest to the apparatus near the collar bone) on the backswing. The apparatus on the non-hitting arm should not be touching the torso/body (ribcage) when taking the racket back to create enough down force to hit the slice aggressively and finished with the apparatus on the non-hitting arm on the torso to keep balance with the hitting arm. The apparatus is strapped on the opposite sides for the left handers.

a) The apparatus and method helps the player to correctly position the arm on the backswing to hit an aggressive slice by creating more racket speed (snap from the elbow) and down force swing.

b) As it did with the backhand volley (method 3d), it helps the player to rotate the forearm to stay more perpendicular on contact when hitting the tennis ball, which creates more ball speed after the contact and keeps the ball flying through the court lower.

c) The method and the apparatus will create more down force swing path to help the player to finish correctly on the one handed backhand slice.

d) The apparatus placed on the armpit of the non-hitting arm helps the player to keep the racket back high to generate enough down swing force creating more under-spin, powerful down force, and fast racket speed.

An aspect of the invention provides a tennis swing training apparatus 100, which comprises a spherical member 10 and a strap member 20.

The spherical member 10 has a connection device 12, and the strap member 20 goes through the spherical member 10 through a hole or slit 12 provided in or through the spherical member 10. The strap member 20 is configured to be worn on a user's arm 90A so as to prevent the spherical member 10 from dropping, moving, or coming off.

The spherical member 10 is configured to be placed between the user's arm 90A and torso 90T during a tennis swing, so as to provide feedback about the tennis swing to the user through touching or squeezing of the spherical member 10 on one or more portions of the user's body, and alert the user so that the user corrects the tennis swing during the tennis swing.

The spherical member 10 may be fabricated of rubber, plastic, polyurethane, or their combination, to which it is not limited.

Another aspect of the invention, a tennis swing training apparatus 100 comprises a resilient ball 10 and a strap member 20.

The resilient ball 10 has a connection device 12, and a strap member 20 goes through the resilient ball 10 through a hole or slit 12 provided in the resilient ball 10, and the strap member 20 is configured to be worn on a user's arm 90A so as to prevent the resilient ball 10 from dropping, moving, or coming off.

The resilient ball 10 is configured to be placed between the user's arm 90A and torso 90T during a tennis swing, so as to provide feedback about the tennis swing to the user 90 through touching or squeezing of the resilient ball 10 on one or more portions of the user's body, and alert the user 90 so that the user 90 corrects the tennis swing during the tennis swing.

The resilient ball 10 may be fabricated of foam or sponge. The foam or sponge may have a substantially rigid outer surface.

The resilient ball 10 may be configured to slide on the strap member 20 with substantial force so as to accommodate different arm sizes of the user 90.

In the first embodiment, the spherical member 10 may be fabricated with a resilient material on one half of the spherical member 10, and the other half of the spherical member 10 may be fabricated with a contouring material so as to prevent movement of the spherical member 10 when the user's arm muscles flex.

In the above two aspects of the invention, the strap member 20 may be fabricated of rubber, neoprene, fiber, cloth, polyester, polyurethane, plastic, nylon, synthetic weave, or combination thereof.

The tennis swing training apparatus 100 may be configured to stabilize shoulder, elbows, and arms of the user 90 so as to use a wrist properly which controls a face of a racket 99 on contact of a tennis ball.

The spherical member 10 may have a substantially rigid outer surface.

The spherical member 10 may be configured to slide on the strap member 20 with substantial force so as to accommodate different arm sizes of the user 90.

In the figures, in order to show how the user 90 poises, a plurality of body parts of the user 90 are shown with reference numerals, such as 90F for face, 90CN for chin, 90CT for chest, 90H for head, 90N for non-hitting arm, 90R for ribcage, and 90AP for armpit.

The above tennis swing training apparatus 100 according to the invention may be used on specific positions on the arms for different types of shots in tennis to fix common swing problems of; One-handed forehand, two-handed backhand, one-handed backhand, volleys, serves and overhead, and one-handed slice backhand.

The above tennis swing training apparatus 100 may be used between the arms 90A and the torso 90T of the user 90 to separate or keep together a position, or activate a particular muscle group throughout a tennis swing.

Still another aspect of the invention provides a tennis swing training apparatus 100 comprising a spherical member 10 fabricated of resilient material and a strap member 20 extending from two portions of the spherical member 10 and making a closed ring shape, so that the strap member 10 is configured to be worn on an arm 90A of a user 90 so as to prevent the spherical member 10 from dropping, moving, or coming off during a tennis swing, and the spherical member 10 is configured to be placed between the user's arm 90A and torso 90T during a tennis swing, so as to provide feedback about the tennis swing to the user 90 through touching or squeezing of the spherical member 10 on one or more portions of the user's body, and alert the user 90 so that the user 90 corrects the tennis swing during the tennis swing.

This embodiment can be described using FIG. 2, in which the strap member 20 can be considered to be a single strap without details of strap portion 22, fastener 24, VELCRO® 26, and a loop 28. Originally, as an embodiment, the fastener 24 and the VELCRO® 26 form a hook-and-loop fastener, but in this aspect, the strap member is provided monolithically with a predetermined elasticity enabling the user 90 to wear it on his or her arm.

The strap member 20 may be detachable from the spherical member 10.

Alternatively, the strap member 20 may be fixed to the spherical member 10, and the strap member 20 comprises a first strap portion, a first fastener, a second strap portion, and a second fastener, which is similar to the first two embodiments of the invention described in the above, except for the fact that the strap member 20 is connected to the spherical member 10 fixedly.

The first strap portion extends from a first portion of the spherical member 10, and the first fastener is provided at an end of the first strap portion. The first fastener may be considered as one of the fastener 24 and the VELCRO® 26.

The second strap portion extends from a second portion of the spherical member 10, and the second fastener is provided at an end of the second strap portion and being configured to be fastened detachably to the first fastener. The second fastener may be considered as the other one of the fastener 24 and the VELCRO® 26.

The first and second strap members fastened to each other through the first and second fasteners are configured to be worn on an arm of a user so as to prevent the spherical member from dropping, moving, or coming off during a tennis swing, so that the spherical member 10 is configured to be placed between the user's arm 90A and torso 90T during a tennis swing, so as to provide feedback about the tennis swing to the user 90 through touching or squeezing of the spherical member 10 on one or more portions of the user's body, and alert the user 90 so that the user 90 corrects the tennis swing during the tennis swing.

The inventor has been in the tennis industry for over 20 years now and when the inventor talks to a tennis coach, a lot of them are not very confident in what they are saying to correct a swing. A lot of the coaches, leave the swing as is since it is very difficult to fix a tennis swing effectively. Even the top coaches, the best coaches in the world, do not have an answer to fix some of the simplest symptoms of an improper tennis swing because they had the talent to play tennis, not to analyze and help fix a swing. With this method the inventor would like to bring together all the tennis coaches and have a similar mindset to make it easier for not only the coaches but for the players that need help with their swings. Even if this method does not bring the coaches together globally, the inventor is confident to say that this method can be used to start uniting, creating, and or to improve a tennis school and or a tennis academy. The inventor knows this from his coaching experience and first-hand experience in not only attending several top tennis academies in the United States, but actually having a full scholarship at one of the top tennis academies.

Also another benefit of having this manual is to be able to fix your students, then the students could fix their students, thus the whole tennis community can have correct information about how to help someone to reproduce a correct and proper swing. Top level junior players and players in academies in general get better because they practice a lot and the amount of time they spend on the court far more than a non-frequent player. With the apparatus and the method, the learning process and fixing process to reproduce a better tennis swing in less amount of time will close the gap from individual players to academy attending players and save them money by shortening the amount of time to master a proper swing. For schools and academies, it will have a chance to work with players with different aspects of their games, such as; footwork, mentality, intensity of the training, nutrition, strategy, tactics, and other non-swing related aspects of tennis to win in a match. Thus as a whole, the tennis community will evolve and will revolutionize how the game is played.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A tennis swing training apparatus comprising:

a spherical member having a connection device; and a strap member going through the spherical member through a hole or slit provided in the spherical member, the strap member being configured to be worn on a user's arm so as to prevent the spherical member from dropping, moving, or coming off, wherein the spherical member is configured to be placed between the user's arm and torso during a tennis swing, so as to provide feedback about the tennis swing to the user through touching or squeezing of the spherical member on one or more portions of the user's body, and alert the user so that the user corrects the tennis swing during the tennis swing, wherein the spherical member is fabricated with a resilient material on one half of the member, and wherein the other half of the spherical member is fabricated with a contouring material so as to prevent movement of the spherical member when the user's arm muscles flex and to prevent any discomfort when the apparatus is worn on the bare skin.

2. The tennis swing training apparatus of claim 1, wherein the spherical member is fabricated of rubber.

3. The tennis swing training apparatus of claim 1, wherein the spherical member is fabricated of plastic.

4. The tennis swing training apparatus of claim 1, wherein the spherical member is fabricated of polyurethane.

5. The tennis swing training apparatus of claim 1, wherein the strap member is fabricated of rubber, neoprene, fiber, cloth, polyester, polyurethane, plastic, nylon, synthetic weave, or combination thereof.

6. The tennis swing training apparatus of claim 1, being configured to stabilize shoulder, elbows, and arms so as to use a wrist properly which controls a face of a racket on contact of a tennis ball.

7. The tennis swing training apparatus of claim 1, wherein the spherical member has a substantially rigid outer surface.

8. The tennis swing training apparatus of claim 1, wherein the spherical member is configured to slide on the strap member with substantial force so as to accommodate different arm sizes of the user.

* * * * *